US006943504B1

(12) United States Patent
York

(10) Patent No.: US 6,943,504 B1
(45) Date of Patent: Sep. 13, 2005

(54) OPEN LOOP MAGNETIC BOOST LED DRIVER SYSTEM AND METHOD

(75) Inventor: Truc Linh York, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/720,953

(22) Filed: Nov. 24, 2003

(51) Int. Cl.[7] ..... H05B 37/02; H05B 41/24

(52) U.S. Cl. ..... 315/224; 315/247; 323/288

(58) Field of Search ..... 315/169.1, 224, 315/225, 247, 209 R, 242–244; 363/21.01, 363/21.17, 95, 97; 323/282, 288; H05B 37/02, H05B 41/24

(56) References Cited

U.S. PATENT DOCUMENTS

| | | | | |
|---|---|---|---|---|
| 6,577,512 | B2 | 6/2003 | Tripathi et al. | 363/21.71 |
| 6,586,890 | B2 | 7/2003 | Min et al. | 315/224 |
| 6,760,238 | B2 * | 7/2004 | Charych | 363/97 |

OTHER PUBLICATIONS

"LM2704 Micropower Step-up DC/DC Converter with 550mA Peak Current Limit," *National Semiconductor Corporation,* 2003 (4 pgs.).
"LT1932 Constant-Current DC/DC LED Driver in ThinSOT," *Linear Technology Corporation*, (4 pgs.).

* cited by examiner

*Primary Examiner*—Trinh Vo Dinh
(74) *Attorney, Agent, or Firm*—Merchant & Gould; Brett A. Hertzberg

(57) ABSTRACT

Current is delivered to a load using an open-loop boost circuit topology that is suitable for LED driver applications. An inductor in the circuit is charged when a transistor is active during a first operating phase. The inductor delivers current to the load when the transistor is inactive during a second operating phase. A ramp circuit is enabled by a feed-forward circuit that detects when the inductor enters the charging cycle. The charging time of the inductor is controlled by a comparator that selectively disables the transistor in response to the ramp voltage. The slope of the ramp is adjusted by an external component (e.g., a resistor) such that the charging time is inversely proportional to the square of the input voltage. The value associated with the inductor can be relatively small, and the boost circuit is arranged to operate over a wide range of operating frequencies.

20 Claims, 6 Drawing Sheets

OPEN LOOP MAGNETIC BOOST LED DRIVER SYSTEM AND METHOD

FIELD OF THE INVENTION

The present invention relates to a system and method for controlling the current delivered to a load. More particularly, the load current is delivered by an inductor that is controlled using an open-loop boost circuit topology that is suitable for use in LED driver applications. With the described topology, the value associated with the inductor is relatively small and the boost circuit operates over a wide operating frequency range.

BACKGROUND OF THE INVENTION

Demand for portable electronic devices is increasing each year. Example portable electronic devices include: laptop computers, personal data assistants (PDAs), cellular telephones, and electronic pagers. Portable electronic devices place high importance on total weight, size, and battery life for the devices. Many portable electronic devices employ rechargeable batteries such as Nickel-Cadmium (NiCad), Nickel-Metal-Hydride (NiMHi), Lithium-Ion (Li-Ion), and Lithium-Polymer based technologies.

In many portable power applications, a voltage that exceeds the battery voltage is required to operate certain circuits such as a video display. DC—DC converters are switching-type regulators that can be used to generate higher output voltages from a battery voltage. The output voltage is typically provided to a load circuit by varying the conduction time that is associated with a controlled device. Example controlled devices include transistors, gate-turn-on (GTO devices), thyristors, diodes, as well as others. The frequency, duty cycle, and conduction time of the controlled device is varied to adjust the average output voltage to the load. Typical DC—DC converters are operated with some sort of oscillator circuit that provides a clock signal. The output voltage of the converter is also determined by the oscillation frequency associated with the clock signal.

For display applications such as stacked light emitting diodes (LEDs), the DC—DC converter often employs a constant frequency current mode control scheme. An example of a conventional closed loop control circuit (100) for driving LEDs is illustrated in FIG. 1. Circuit 100 includes an oscillator, an SR-type latch, an inductor (L1), two transistors (Q1, Q2), a Schottky diode (D1), two capacitors (C1, C2), three resistors ($R_{SET}$, $R_{SNS1}$, $R_{SNS2}$), three amplifiers ($A_1$–$A_3$), two driver circuits ($DRV_1$, $DRV_2$), a reference circuit (REF), a summer, and the LED stack ($D_2$–$D_5$).

At the start of each cycle of the oscillator, the SR latch is set and transistor $Q_1$ is turned on via driver circuit $DRV_1$. Amplifier $A_3$ produces a sense voltage ($V_{SNS1}$) by sensing the switching current from transistor $Q_1$ via sense resistor $R_{SNS1}$. The signal ($V_{SUM}$) at the non-inverting input of the PWM comparator ($A_2$) is determined by the switch current via $V_{SNS1}$, summed together with a portion of the oscillation ramp signal. Amplifier $A_1$ is an error amplifier that provides an error signal ($V_{ERR}$) by evaluating the drive current ($I_{LED}$) via transistors $Q_2$ and resistor $R_{SNS2}$. The PWM comparator ($A_2$) resets the SR latch and turns off transistor $Q_1$ when the sum signal ($V_{SUM}$) reaches the level set by the error signal ($V_{ERR}$). Thus, amplifier $A_1$ and driver circuit DRV1 set the peak current level to keep the drive current ($I_{LED}$) in regulation. Resistor $R_{SET}$ is adjusted to change the peak current level via a reference circuit (REF) and amplifier $A_1$.

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
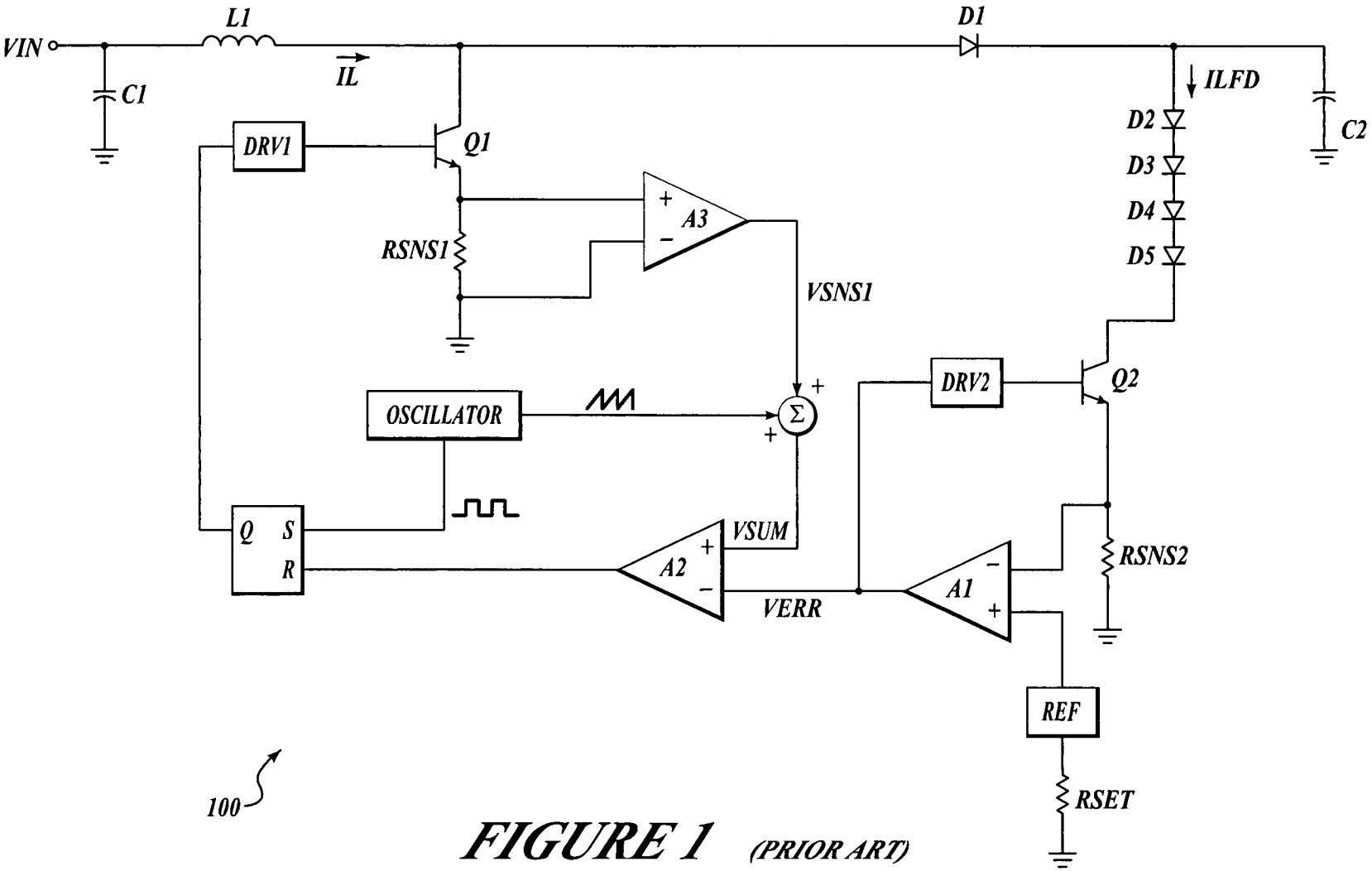
FIGURE 1 (PRIOR ART)
FIG. 1 is an illustration of a conventional DC—DC converter.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal.

Briefly stated, the invention is related to an apparatus, system and method for controlling the current delivered to a load. Current is delivered to the load using an open-loop boost circuit topology that is suitable for LED driver applications. An inductor in the circuit is charged when a transistor is active during a first operating phase. The inductor delivers current to the load when the transistor is inactive during a second operating phase. A ramp circuit is enabled by a feed-forward circuit that detects when the inductor enters the charging cycle. The charging time of the inductor is controlled by a comparator that selectively disables the transistor in response to the ramp voltage. The slope of the ramp is adjusted by an external component (e.g., a resistor) such that the charging time is inversely proportional to the square of the input voltage. The value associated with the inductor can be relatively small, and the boost circuit is arranged to operate over a wide range of operating frequencies.

Figure 2:
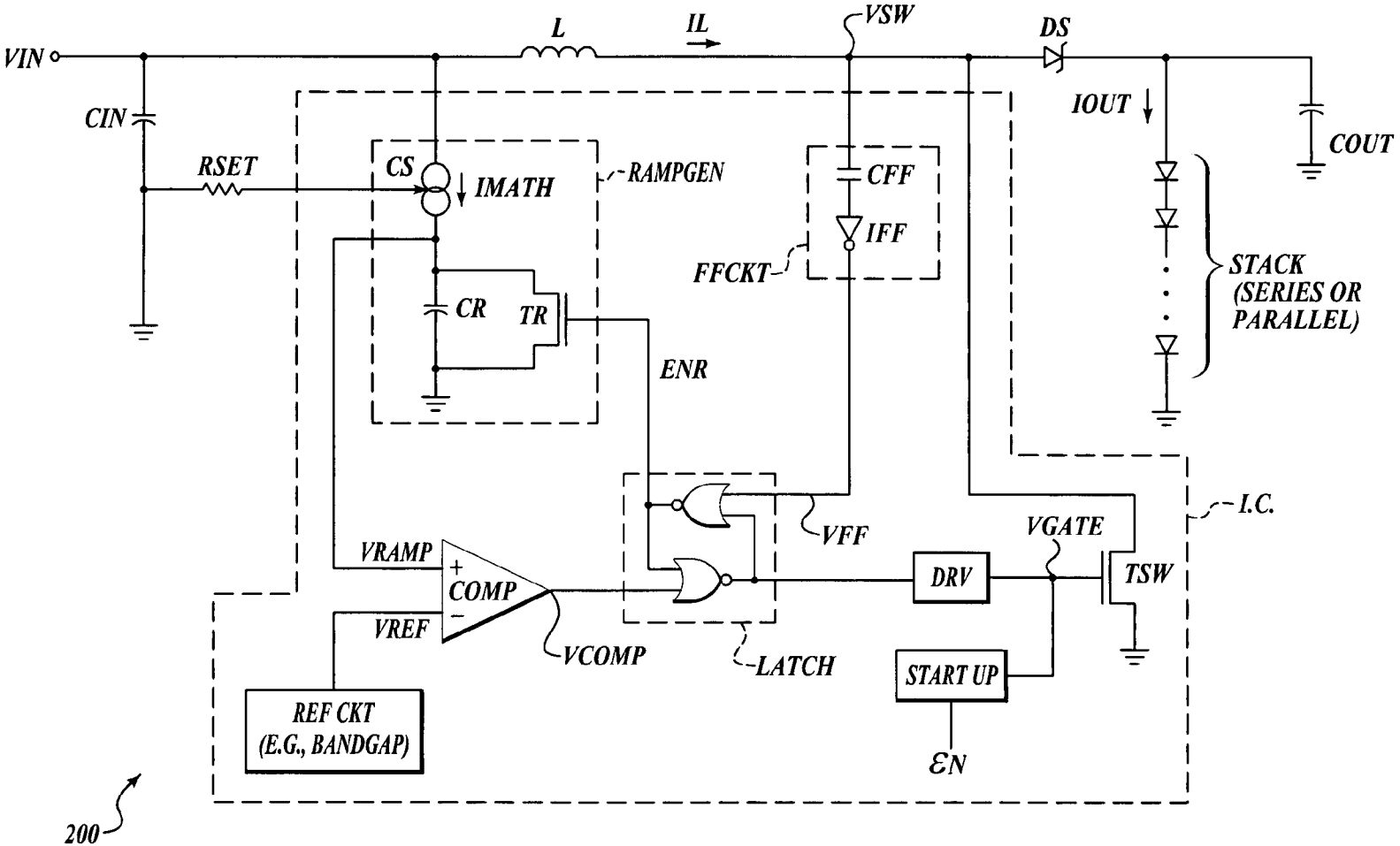
FIG. 2 is an illustration of an example open-loop boost circuit.

FIG. 2 is an illustration of an example open-loop boost circuit (200) that is arranged in accordance with an embodiment of the present invention. The open-loop boost circuit (200) includes: two capacitors ($C_{IN}$, $C_{OUT}$), an inductor (L), a stack circuit ($D_1, D_2, \ldots, D_N$), a Schottky-type diode ($D_S$), a feed-forward circuit (FFCKT), a latch circuit (LATCH), a ramp generator circuit (RAMPGEN), a resistor ($R_{SET}$), a comparator (COMP), a reference circuit (REF CKT), a transistor switch circuit ($T_{SW}$), a driver circuit (DRV), and a start-up circuit (STARTUP).

Capacitor $C_{IN}$ is coupled between the input voltage ($V_{IN}$) and ground. Resistor $R_{SET}$ is coupled between the RAMPGEN and ground. RAMPGEN is arranged to provide a ramp voltage ($V_{RAMP}$) with a known slope when enabled. Ramp voltage $V_{RAMP}$ corresponds to ground when RAMPGEN is disabled via signal ENR. REF CKT is arranged to provide a voltage reference ($V_{REF}$). Inductor L is selectively coupled to ground through transistor switch circuit $T_{SW}$ when transistor switch circuit $T_{SW}$ is active, and coupled to the stack circuit through Schottky diode $D_S$ when transistor switch circuit $T_{SW}$ is inactive. The stack circuit is coupled between Schottky diode $D_S$ and ground. Capacitor $C_{OUT}$ is coupled in parallel with the stack circuit to minimize ripple in the output voltage ($V_{OUT}$). Feed-forward circuit FFCKT is arranged to sense the voltage ($V_{SW}$) associated with the non-input side of inductor L and provides a signal to an input of latch circuit LATCH. Comparator COMP is arranged to compare ramp voltage $V_{RAMP}$ to reference voltage $V_{REF}$ and provide a comparison signal ($V_{COMP}$) to another input of latch circuit LATCH. One output of latch circuit LATCH is arranged to provide signal ENR. Another output of latch circuit LATCH is arranged to selectively activate transistor switch circuit $T_{SW}$ via driver circuit DRV and signal $V_{GATE}$. Start up circuit START UP is arranged to force signal $V_{GATE}$ during a start-up sequence (when EN is active) such that inductor L is charged and the latch is initialized to an appropriate condition via comparator COMP and the feed-forward circuit.

An example feed-forward circuit includes a capacitor ($C_{FF}$) and an inverter circuit (IFF), which are coupled between signal $V_{SW}$ and an input of the latch circuit. Changes in the signal $V_{SW}$ are detected by the capacitor and fed to the latch circuit as signal $V_{FF}$. For example, $V_{FF}$ corresponds to a low logic level until $V_{SW}$ drops below a threshold associated with inverter circuit IFF, where $V_{FF}$ pulses as a high logic pulse.

Latch circuit LATCH is illustrated as two NOR logic gates that are coupled together as shown in FIG. 2. However, other latch circuits are within the scope of the present invention including NAND gate implementations, and other logic configurations that provide a similar function.

Ramp generator RAMPGEN is illustrated as a current source (CS) that has an output coupled to a capacitor ($C_R$), and an input that is coupled to resistor RSET. Transistor switching circuit $T_{SW}$ is configured to short capacitor ($C_R$) to ground when signal ENR is active such that the ramp is reset to a known value before each ramp cycle begins. Current source CS provides a current ($I_{MATH}$) to capacitor $C_R$ such that the capacitor charges at a constant rate. The charging rate is adjusted by changing the magnitude of current $I_{MATH}$, which is adjusted by resistor $R_{SET}$.

The output current ($I_{OUT}$) is adjusted by changing a value associated with resistor $R_{SET}$, which in turn adjusts the slope of ramp voltage $V_{RAMP}$. The slope of ramp voltage $V_{RAMP}$ controls the on-time ($T_{ON}$, see FIG. 3) associated with transistor switch circuit $T_{SW}$, which in turn controls the charging of inductor L. For example, comparator COMP controls the gate voltage ($V_{GATE}$) via driver circuit DRV and latch circuit LATCH such that transistor switching circuit $T_{SW}$ is disabled when the ramp voltage ($V_{RAMP}$) exceeds the reference voltage ($V_{REF}$).

Circuit 200 is arranged to operate as an open-loop driver circuit that operates on the edge of constant-current mode (CCM) and discontinuous-current mode (DCM). The output current ($I_{OUT}$) is provided to a load such as a stack of LEDs as illustrated in FIG. 2. The load may also be a parallel combination of LEDs, a different series combination of LEDs, or some other device or devices that have a predictable voltage when driven with a known current. The overall topology can be implemented as an integrated circuit (IC) that has characteristics such as: minimal die size, high efficiency, high operating frequency, low operating current, and very low values (e.g., 1 uH) of inductance for L.

Figure 3A:
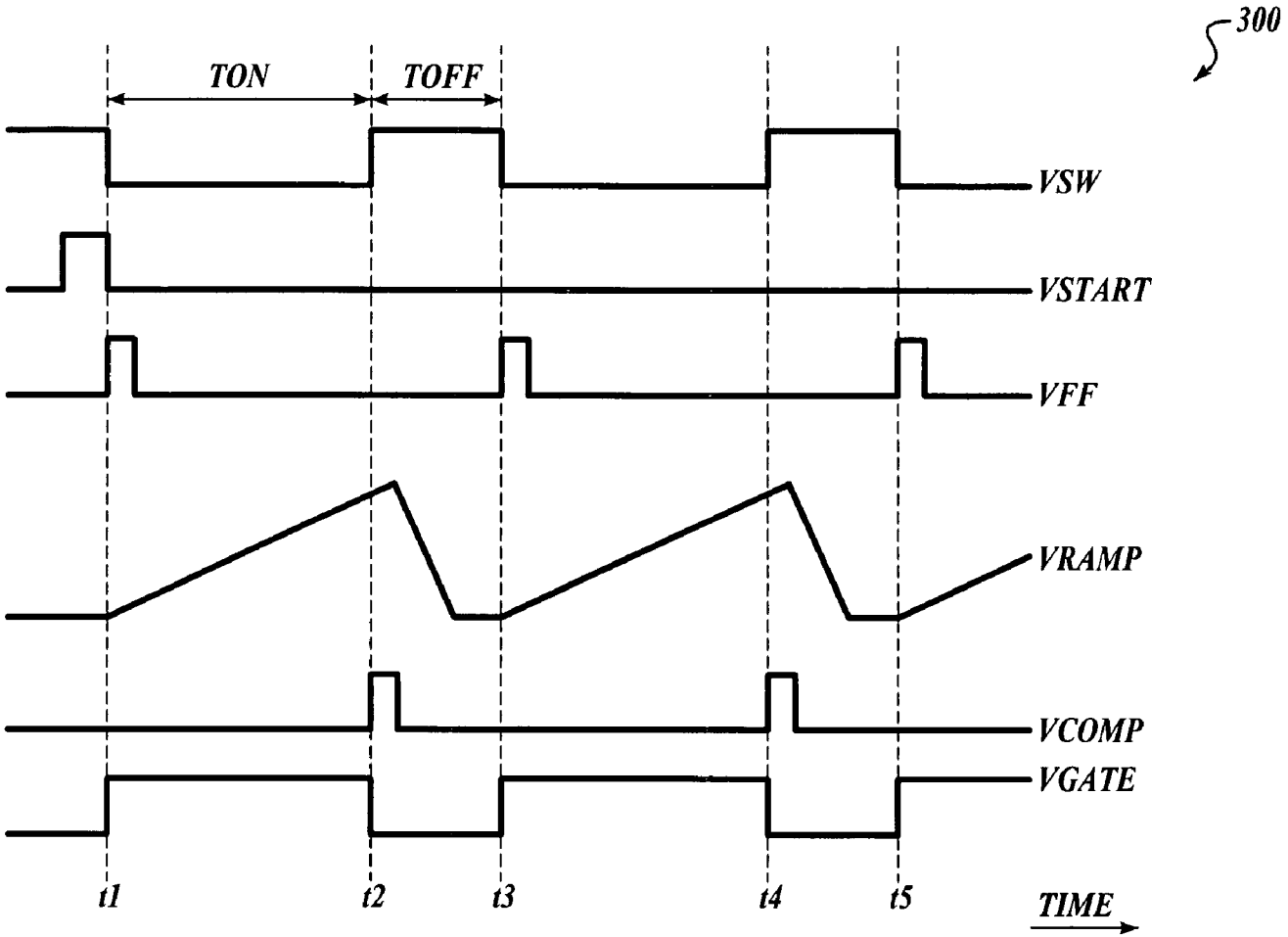
FIG. 3A is an illustration of example signal waveforms for the circuit illustrated in FIG. 2.
Figure 3B:
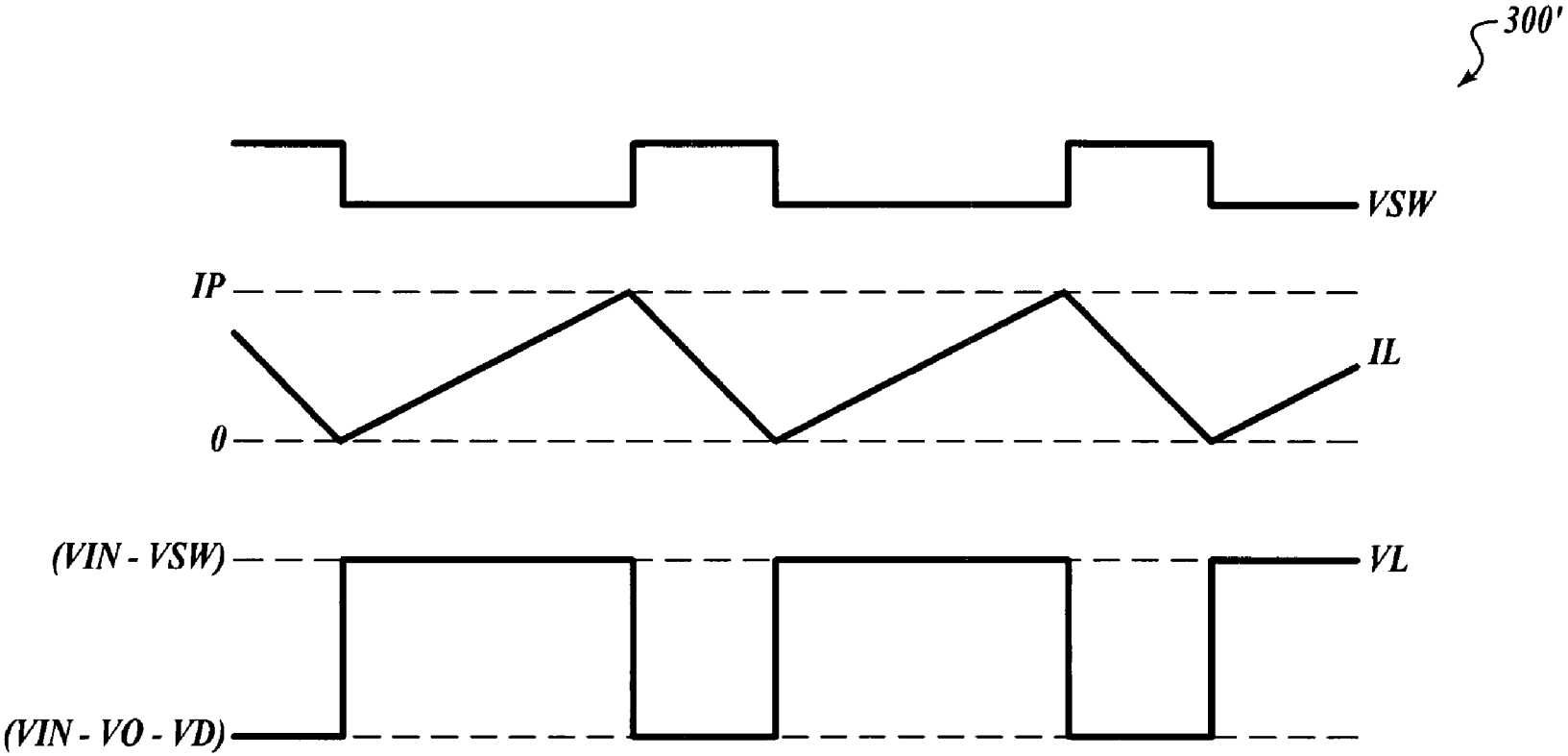
FIG. 3B is an illustration of additional example signal waveforms for the circuit illustrated in FIG. 2.

FIG. 3A and FIG. 3B are illustrations of example signal waveforms for the circuit illustrated in FIG. 2. As illustrated in the figures, the inductor is charged during the on-time interval ($T_{ON}$) and discharged to the load during the off-time interval ($T_{OFF}$). The on-time interval is active from time $t_1$ through $t_2$, while the off-time interval is active from time $t_2$ through $t_3$. The cycle repeats again as illustrated by times $t_3$ through $t_5$.

From times $t_1$ through $t_2$, transistor switching circuit $T_{SW}$ is activate and signal RES corresponds to a low logic level such that the ramp generator (RAMPGEN) is enabled. The switch voltage ($V_{SW}$) is approximately the same as the ground voltage (e.g., 0V or $V_{SS}$) depending on the $rds_{ON}$ of transistor $T_{SW}$. The voltage ($V_L$) across inductor L corresponds to $V_L=V_{IN}-V_{SW}$ and inductor L is charged as illustrated by inductor current $I_L$. The ramp voltage ($V_{RAMP}$) increases while signal RES is active. The rate of ramp voltage $V_{RAMP}$ is determined by the charging current ($I_{MATH}$) and the value associated with capacitor $C_R$.

The output of comparator COMP corresponds to a low logic level while ramp voltage $V_{RAMP}$ is below reference voltage $V_{REF}$. At time $t_2$ (and $t_4$), ramp voltage $V_{RAMP}$ exceeds reference voltage $V_{REF}$ by an amount sufficient for comparator circuit COMP to change to a high logic level (see $V_{COMP}$). The latch circuit is responsive to VCOMP such that transistor switching circuit $T_{SW}$ is deactivated when $V_{COMP}$ corresponds to a high logic level signal (e.g., see $V_{GATE}$). The inductor current ($I_L$) reaches a peak value ($I_P$) when transistor switching circuit $T_{SW}$ is deactivated around time $t_2$.

From time $t_2$ through $t_3$ ($T_{OFF}$) transistor switching circuit $T_{SW}$ remains deactivated by the high logic level from the comparator such that the current in the inductor is delivered to the load (e.g., the LED stack). Inductor current ($I_L$) continues to flow to the load via diode $D_S$ until the time $t_3$. At time $t_3$, the inductor current ($I_L$) drops to a current level that is insufficient to forward bias diode $D_S$ ($IL \approx 0$) and the switch voltage ($V_{SW}$) begins to drop. The feed-forward circuit senses the drop in the switch voltage ($V_{SW}$) and generates a pulsed signal ($V_{FF}$) that sets signal RES to a high logic level. After signal RES pulses high, the ramp generator is reset (e.g., $V_{RAMP}$=0V), the output of the comparator is set to a low logic level, and transistor switching circuit $T_{SW}$ is activated. The cycle repeats from time $t_3$ through $t_4$ as recited previously with respect to times $t_1$ through $t_2$. The circuit operation from times $t_4$ through $t_5$ operate substantially the same as that described with reference to times $t_2$ through $t_3$.

The on-time interval ($T_{ON}$) for transistor switching circuit $T_{SW}$ is determined by the reference voltage level ($V_{REF}$) and the rate of the voltage ramp ($V_{RAMP}$). For the example ramp circuit illustrated in FIG. 2, the on-time interval ($T_{ON}$) is determined by:

$$T_{ON}=C_R*V_{REF}/I_{MATH} \quad \text{(Eq. 1)}$$

The current source (CS) is arranged such that current $I_{MATH}$ is related to the square of the input voltage ($V_{IN}$) and the value associated with resistor $R_{SET}$ as:

$$I_{MATH}=R_{SET}*V_{IN}^2/(V_{REF}2*R^2) \quad \text{(Eq. 2)}$$

where $V_{RSET}$ is another reference voltage and R is another resistor in the current source circuit (CS).

Substituting equation 2 into equation 1 yields:

$$T_{ON}=C_R*V_{REF}/(R_{SET}*V_{IN}^2/(V_{RSET}*R^2))$$

$$T_{ON}=C_R*V_{REF}*V_{RSET}*R^2/(R_{SET}*V_{IN}^2)$$

$$T_{ON}=K/V_{IN}^2, \quad \text{(Eq. 3)}$$

where K is a constant given by $K=V_{REF}*V_{RSET}*R^2/R_{SET}$.

The efficiency (eff) of the circuit is determined by the ratio of the output power ($P_{OUT}$) to the input power ($P_{IN}$) as, where the output power ($P_{OUT}$) is given by:

$$P_{OUT}=eff*P_{IN} \quad \text{(Eq. 4)}$$

The output power ($P_{OUT}$) is related to the average output current ($I_{OUTAV}$) and the output voltage ($V_{OUT}$) as $P_{OUT}=V_{OUT}*I_{OUTAV}$, while the input power ($P_{IN}$) is similarly related to the average input current ($I_{INAV}$) and the input voltage ($V_{IN}$) as $P_{IN}= V_{IN}*I_{INAV}$. Substituting into equation 4 yields:

$$V_{OUT}*I_{OUTAV}=eff*V_{IN}*I_{INAV} \quad \text{(Eq. 5)}$$

Solving for the average output current ($I_{OUT}$) yields:

$$I_{OUTAV}=eff*V_{IN}*I_{INAV}/V_{OUT} \quad \text{(Eq. 6)}$$

The inductor current ($I_L$) is related to the inductor voltage ($V_L$) as:

$$d\ I_L(t)/dt=V_L(t)/L \quad \text{(Eq. 7)}$$

Since the current peaks at a value of $I_P$ over the time interval $T_{ON}$, equation 7 can be represented as:

$$I_P/T_{ON}=V_{IN}/L \quad \text{(Eq. 8)}$$

Solving equation 8 for the peak current yields:

$$I_P=V_{IN}*T_{ON}/L \quad \text{(Eq. 9)}$$

The average value of the input current corresponds to half of the peak current such that:

$$I_{INAV}=I_P/2$$

$$I_{INAV}=V_{IN}*T_{ON}/(2*L) \quad \text{(Eq. 10)}$$

Substituting equation 10 into equation 6 yields:

$$I_{OUTAV}=eff*V_{IN}*(V_{IN}*T_{ON}/(2*L))/V_{OUT}$$

$$I_{OUTAV}=eff*V_{IN}^2*T_{ON}/(2*L*V_{OUT}) \quad \text{(Eq. 11)}$$

Substituting equation 3 into equation 11 yields:

$$I_{OUTAV}=eff*V_{IN}^2*(K/V_{IN}^2)/(2*L*V_{OUT})$$

$$I_{OUTAV}=eff*K/(2*L*V_{OUT}) \quad \text{(Eq. 12)}$$

As observed in the equations listed above, the output current ($I_{OUT}$) is independent of the input voltage ($V_{IN}$). Instead, the output current is inversely proportional to the value of the inductor (L) and a series of constants. The current source circuit (CS) is arranged such that the on-time is adjusted via resistor $R_{SET}$ in such as way that the output current ($I_{OUT}$) is inversely proportional to the value associated with $R_{SET}$. In one example, current source CS described above is arranged to provide a current that is proportional to $R_{SET}*V_{IN}^2$.

Figure 4:
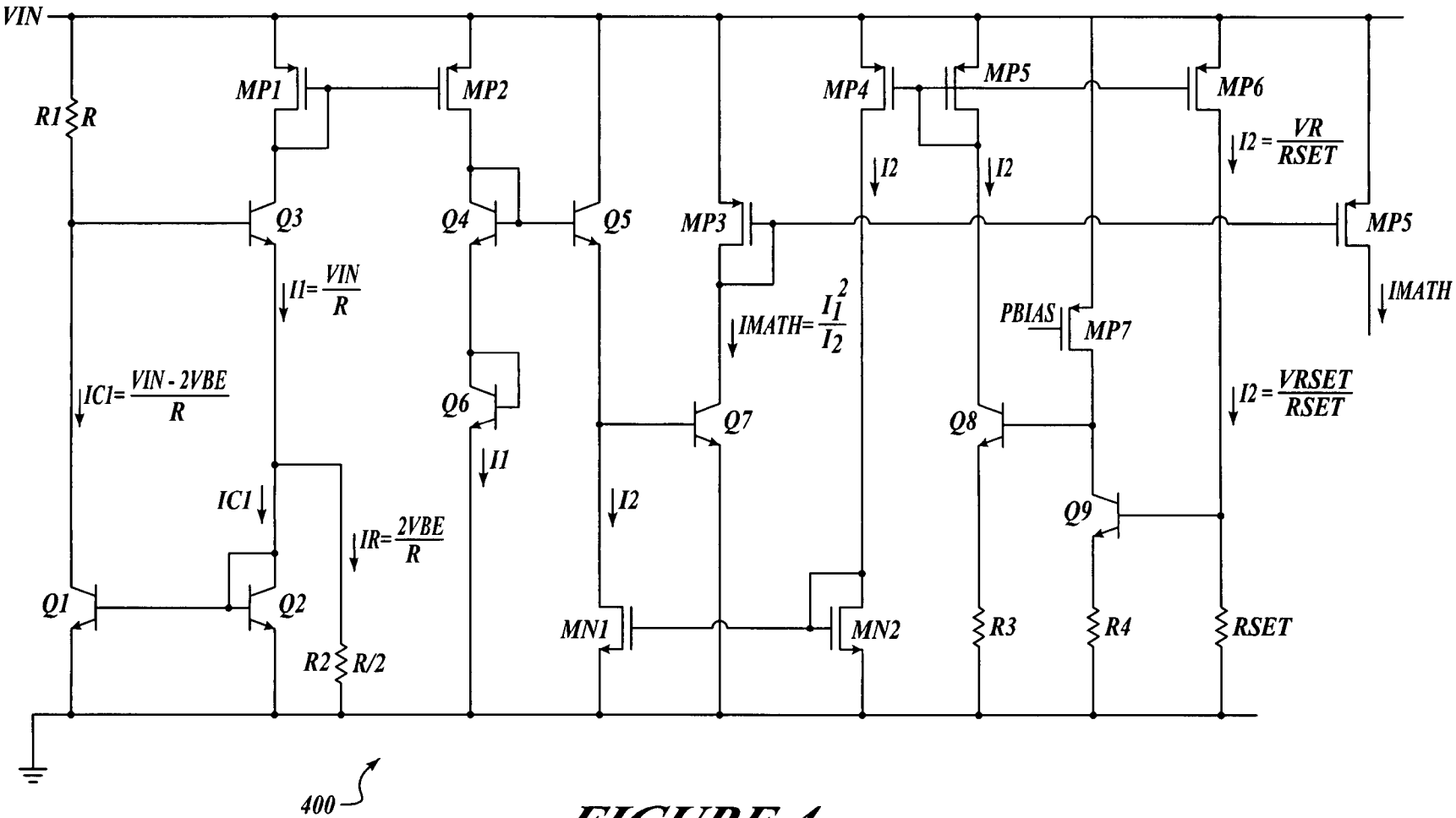
FIG. 4 is an illustration of an example current adjustment circuit for the circuit illustrated in FIG. 2.

FIG. 4 is an illustration of an example current adjustment circuit for the circuit illustrated in FIG. 2. $R_{SET}$ is included in FIG. 2 for reference. The example current adjustment circuit is arranged to provide an output current ($I_{MATH}$) that is proportional to $R_{SET}*V_{IN}^2$.

Transistors $Q_2$ and $Q_3$ are arranged to provide a voltage across resistor $R_1$ to set the collector current ($I_{C1}$) of transistor $Q_1$ as: $I_{C1}=(V_{IN}-2V_{BE})/R$, where resistor $R_1$ has a value corresponds to R. Transistors $Q_1$ and $Q_2$ are arranged in a current mirror configuration such that they have substantially the same collector current. Resistor $R_2$ has a value corresponding to R/2, and is arranged in parallel with transistor $Q_2$ such that the current through resistor $R_2$ corresponds to $I_{R2}=2V_{BE}/R$. The resulting collector current ($I_{C3}$) through transistor $Q_3$ corresponds to $V_{IN}/R$.

Transistors $M_{P1}$ and $M_{P2}$ are arranged in a current mirror configuration such that their drain currents are ratio matched ($X*I_{D1}=I_{D2}$), where drain current $I_{D1}$ is given by $I_{D1}=I_Q=V_{IN}/R$. Transistors $Q_4$ and $Q_6$ are arranged to operate as diodes that are biased by current $I_{D2}=X*\ V_{IN}/R$.

Transistor $M_{P7}$ is biased to operate as a current source from another circuit (not shown) such as a band-gap reference, and provide current to the collector of transistor $Q_9$. Transistors $Q_9$ generates a reference voltage ($V_{RSET}$) that corresponds to $V_{BE9}+I_{D7}*R_4$. Transistor $Q_8$ and resistor $R_3$ are arranged to sense the collector voltage of transistor $Q_9$ to generate current $I_2$. Transistor $M_{P5}$ and $M_{P6}$ are arranged in a current mirror configuration such that their drain currents are ratio matched ($I_{D5}=Y*I_{D6}$). Transistor $M_{P5}$ senses the collector current ($I_{C8}$) from transistor $Q_8$ and reflects the current to resistor $R_{SET}$ via transistor $M_{P6}$. The resulting current for current I2 corresponds to $V_{RSET}/R_{SET}$.

Transistors $M_{P4}$ and $M_{P5}$ are arranged in a current mirror configuration such that their drain currents are ratio matched ($I_{D4}=Z*I_{D5}$). Transistors $M_{N1}$ and $M_{N2}$ are also arranged in a current mirror configuration such that their drain currents are ratio matched ($I_{D1}=A*I_{D2}$). Transistors $M_{P4}$, $M_{N2}$, and $M_{N1}$ are arranged to reflect current proportional to $I_2$ to the drain of transistor $M_{N1}$. The drain of transistor $M_{N1}$ is coupled to the emitter of transistor $Q_5$ and the base of transistor $Q_7$. Since transistor $Q_5$ has a collector current of $I_1$ and transistor $M_{N1}$ has a drain current of $I_2$, the base current to transistor $Q_7$ corresponds to ($I_1-I_2$), resulting in a collector current for transistor $Q_7$ that is proportional to $I_1^2/I_2$. Transistors $M_{P3}$ and $M_{PS}$ are arranged in a current mirror configuration such that their drain currents are ratio matched ($I_{D3}=B*I_{DS}$). The resulting current at the drain of transistor $M_{PS}$ corresponds to $I_{MATH}=I_1^2/I_2$. Since $I_1$ is proportional to $V_{IN}/R$, and $I_2$ is proportional to $V_{RSET}/R_{SET}$, then $I_{MATH}$ is proportional to the ratio: $(V_{IN}/R)^2/(V_{RSET}/R_{SET})$ or $(R_{SET}*V_{IN}^2/(V_{RSET}*R^2))$.

Figure 5:
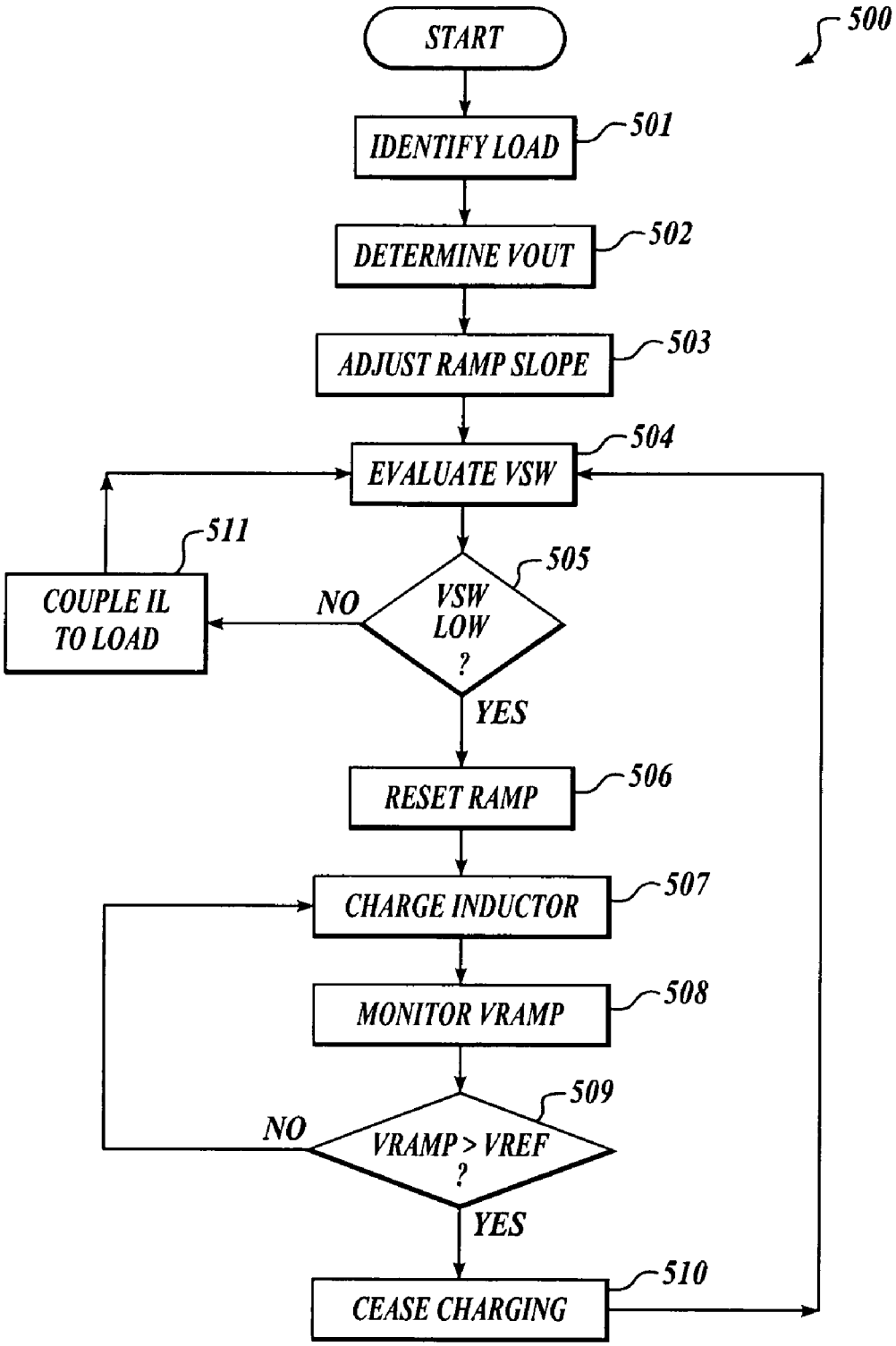
FIG. 5 is an illustration of an example procedural flow for an open-loop boost circuit, arranged in accordance with the present invention.

FIG. 5 is an illustration of an example procedural flow for an open-loop boost circuit that is arranged in accordance with the present invention. At block 501, a load is identified. In one example, the load corresponds to a number of LEDs for operation as stacked diodes (e.g., see FIG. 2). Continuing to block 502, the output voltage requirements are determined from the identified load (e.g., the operating voltage for the stacked devices). Proceeding to block 503, the slope of the ramp is adjusted (e.g., changing a value associated with resistor RSET) based on the identified load's output current and voltage requirements.

Operation of the driver circuit begins at block 503, where the output driver current is automatically changed (e.g., automatically adjusting a current source) based on the selected ramp. Continuing to block 504 the switch voltage is evaluated by the circuit. Processing continues from block 504 to decision block 505. The process flows from decision block 505 to block 511 when the switch voltage ($V_{SW}$) is evaluated as high indicating that the switching circuit is in the $T_{OFF}$ interval. At block 511, current from the inductor ($I_L$) is delivered to the load circuit (e.g., $T_{SW}$ is deactivated and $I_L$ couples through $D_S$ to the load). Alternatively, processing flows from decision block 505 to block 506 when the switch voltage ($V_{SW}$) is evaluated as low indicating that the switching circuit is in the $T_{ON}$ interval.

The ramp is reset at block 506 such that a ramp voltage ($V_{RAMP}$) is initialized to a predetermined level (e.g., one of the power supply voltages, ground, etc). Continuing to block 507, the inductor is charged (e.g., $T_{SW}$ is active and the inductor charges with $V_{IN}$). At block 508 the ramp voltage is monitored. Processing continues from decision block 509 to block 510 when the ramp voltage ($V_{RAMP}$) exceeds a reference voltage ($V_{REF}$). Alternatively, processing continues from decision block 509 to block 507 when the ramp voltage ($V_{RAMP}$) has not exceeded the reference voltage ($V_{REF}$).

At decision block 509, the process evaluates the ramp enable signal. Processing continues from decision block 509 to block 510, where the inductor is charged while the ramp is enabled. Alternatively, processing continues from decision block 509 to block 511, where the charging of the inductor is terminated when the ramp is detected as disabled. Processing continues from block 510 to block 507, where the ramp voltage is continually monitored until the ramp reaches $V_{REF}$ (where $T_{ON}$ is terminated). Processing flows from block 511 to block 504 where the next cycle begins.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for controlling an output current ($I_{OUT}$) that is delivered to a load circuit from an inductor, the apparatus comprising:

a transistor switching circuit that is arranged to selectively couple a switch node to a power supply when activated, such that the inductor is charged by an input voltage ($V_{IN}$) when the transistor switching circuit is activated, wherein the inductor is arranged to deliver the output current ($I_{OUT}$) to the load circuit when the transistor switching circuit is deactivated;

a ramp generator circuit that is arranged to provide a ramp signal ($V_{RAMP}$), wherein the ramp signal ($V_{RAMP}$) is reset to a predetermined level in response to a reset signal (ENR);

a comparator circuit that is arranged to compare the ramp signal ($V_{RAMP}$) to a reference signal ($V_{REF}$) to provide a comparison signal ($V_{COMP}$), wherein the comparison signal ($V_{COMP}$) is asserted when the ramp signal ($V_{RAMP}$) exceeds the reference signal ($V_{REF}$);

a feed-forward circuit that is arranged to activate a pulse signal ($V_{FF}$) when a voltage ($V_{SW}$) associated with the switch node decreases by a predetermined amount; and a latch circuit that is arranged to: assert the reset signal (ENR) when the pulse signal ($V_{FF}$) is asserted, activate the transistor switching circuit when the reset signal (ENR) and the comparison signal ($V_{COMP}$) are de-asserted, and deactivate the transistor switching circuit when the comparison signal ($V_{COMP}$) is asserted.

2. The apparatus of claim 1, wherein the power supply corresponds to at least one of a high power supply, a low power supply, and a circuit ground.

3. The apparatus of claim 1, further comprising a start-up circuit that is arranged to initialize the latch circuit during a start-up sequence.

4. The apparatus of claim 1, further comprising a start-up circuit that is arranged to activate the inductor during a start-up sequence such that the inductor is initialized to an appropriate condition.

5. The apparatus of claim 1, wherein the ramp generator circuit is further arranged such that a slope associated with the ramp signal ($V_{RAMP}$) is determined by an adjustable parameter (X) and the input voltage ($V_{IN}$) such that the slope is proportional to $X*V_{IN}^2$.

6. The apparatus of claim 1, wherein the transistor switching circuit is further arranged such that the output current ($I_{OUT}$) that is delivered to the load circuit is inversely proportional to $L*V_{OUT}$, where L corresponds to a value associated with the inductor and $V_{OUT}$ corresponds to an output voltage that is associated with the load circuit.

7. The apparatus of claim 1, further comprising: a resistor that is arranged to cooperate with the ramp generator circuit such that a value ($R_{SET}$) associated with the resistor adjusts the slope of the ramp signal ($V_{RAMP}$), wherein the ramp generator circuit and the comparator circuit are arranged to cooperate with the feed-forward circuit such that an on-time ($T_{ON}$) associated with the transistor switching circuit is adjusted by changing the slope of the ramp signal.

8. The apparatus of claim 7, wherein the transistor switching circuit is arranged to cooperate with the inductor such that the output current ($I_{OUT}$) is inversely proportional to $L*R_{SET}$.

9. The apparatus of claim 1, wherein the ramp generator circuit comprises a capacitor ($C_R$) that is charged by a current source (CS) when the reset signal is de-asserted.

10. The apparatus of claim 9, further comprising a resistor that is arranged to cooperate with the ramp generator circuit such that a current level ($I_{MATH}$) associated with the current source (CS) is responsive to a value ($R_{SET}$) associated with the resistor.

11. The apparatus of claim 9, further comprising a resistor that is arranged to cooperate with the ramp generator circuit such that a current level ($I_{MATH}$) associated with the current source (CS) is proportional to $R_{SET}*V_{IN}^2$, wherein the resistor has a value corresponding to $R_{SET}$.

12. An apparatus for controlling an output current ($I_{OUT}$) that is delivered to a load circuit from an inductor, the apparatus comprising:

a switching means that is arranged to selectively couple a switch node to a power supply node when activated, such that the inductor is charged by an input voltage ($V_{IN}$) when the switching means is activated, wherein the inductor is arranged to deliver the output current ($I_{OUT}$) to the load circuit when the switching means is deactivated;

a ramp means that is arranged to provide a ramp signal ($V_{RAMP}$), wherein the ramp means is arranged to initialize the ramp signal ($V_{RAMP}$) to a predetermined level in response to a reset signal (ENR);

a comparison means that is arranged to compare the ramp signal ($V_{RAMP}$) to a reference signal ($V_{REF}$) to provide a comparison signal ($V_{COMP}$), wherein the comparison signal ($V_{COMP}$) is asserted when the ramp signal ($V_{RAMP}$) reaches the reference signal ($V_{REF}$);

a sense means that is arranged to activate a pulse signal ($V_{FF}$) when the voltage ($V_{SW}$) associated with the switch node is sensed as decreasing by a predetermined amount; and a latch means that is arranged to: assert the reset signal (ENR) when the pulse signal ($V_{FF}$) is asserted, activate the switching means when the reset signal (ENR) and the comparison signal ($V_{COMP}$) are de-asserted, and deactivate the switching means when the comparison signal ($V_{COMP}$) is asserted.

13. The apparatus of claim 12, wherein the ramp means is further arranged such that a slope associated with the ramp means is determined by an adjustable parameter (X) and the input voltage ($V_{IN}$) such that the slope is proportional to $X*V_{IN}^2$.

14. The apparatus of claim 12, further comprising: a resistor means that is arranged to cooperate with the ramp means such that a value ($R_{SET}$) associated with the resistor means adjusts the slope of the ramp signal ($V_{RAMP}$), wherein the ramp means and the comparison means are arranged to cooperate with the sense means such that an on-time ($T_{ON}$) associated with a charging cycle of the inductor is adjusted by changing the slope of the ramp signal.

15. The apparatus of claim 12, wherein the ramp means is arranged such that the ramp signal ($V_{RAMP}$) is a decreasing signal and the predetermined level corresponds to a high power supply level.

16. The apparatus of claim 12, wherein the ramp means is arranged such that the ramp signal ($V_{RAMP}$) is an increasing signal and the predetermined level corresponds to a low power supply level.

17. A method for providing a current ($I_{OUT}$) to a load circuit from an inductor, the method comprising:

evaluating a switch signal ($V_{SW}$), wherein the switch signal is associated with the inductor;

monitoring a ramp signal ($V_{RAMP}$), wherein the ramp signal ($V_{RAMP}$) has a magnitude that varies over time according to a slope;

resetting the ramp signal ($V_{RAMP}$) to a reset level when the switch signal ($V_{SW}$) drops below a predetermined level;

controlling an on-time interval in response to the ramp signal ($V_{RAMP}$) and a reference signal level ($V_{REF}$), wherein the on-time interval is related to the slope of the ramp signal ($V_{RAMP}$);

charging the inductor with an input voltage ($V_{IN}$) over the on-time interval ($T_{ON}$); and coupling current from the inductor to the load circuit when a ramp signal level has reached the reference signal level.

18. The method of claim 17, further comprising: identifying requirements associated with the load circuit, and changing the slope of the ramp in response to the identified load requirements, wherein the requirements corresponds to at least one of an operating voltage across the load circuit and an operating current requirement for the load circuit.

19. The method of claim 17, adjusting the slope of the ramp signal in response to a parameter (X) and the input voltage ($V_{IN}$) such that the slope of the ramp signal ($V_{RAMP}$) is proportional to $X*V_{IN}^2$.

20. The method of claim 17, wherein the ramp signal is a decreasing signal that decreases at a rate that is determined by the slope of the ramp signal such that the on-time interval ($T_{ON}$) spans the time period from the reset of the ramp signal until the time where the ramp signal reaches the reference signal level ($V_{REF}$).

* * * * *